US005607231A

United States Patent [19]

Loesch

[11] Patent Number: 5,607,231

[45] Date of Patent: Mar. 4, 1997

[54] METHOD FOR OPERATING AN ASPHALT PLANT FOR BOTH CONTINUOUS AND BATCH OPERATION

[75] Inventor: Leonard A. Loesch, Prospect, Ky.

[73] Assignee: GenTec Equipment Company, Louisville, Ky.

[21] Appl. No.: 398,974

[22] Filed: Mar. 6, 1995

Related U.S. Application Data

[62] Division of Ser. No. 334,528, Nov. 4, 1994, Pat. No. 5,556,197.

[51] Int. Cl.[6] ..... B28C 7/04

[52] U.S. Cl. ..... 366/7; 366/8; 366/25

[58] Field of Search ..... 366/7, 22, 23, 366/24, 25, 8

[56] References Cited

U.S. PATENT DOCUMENTS 2,256,281 9/1941 Finley .
2,750,680 6/1956 Houdry et al. .
2,795,054 6/1957 Bowen, III .
3,423,222 1/1969 McConnaughay .
3,706,445 12/1972 Gentry .
3,787,171 1/1974 Cromp .
3,880,143 4/1975 Hart et al. .
4,165,184 8/1979 Schlarmann .
4,190,370 2/1980 Brock et al. ..... 366/25
4,309,113 1/1982 Mendenhall .
4,387,996 6/1983 Mendenhall .
4,600,379 7/1986 Elliott .
4,705,404 11/1987 Bruggemann .
5,002,398 3/1991 Musil .
5,090,813 2/1992 McFarland et al. .
5,190,371 3/1993 Gjerulff ..... 366/25
5,251,976 10/1993 Milstead ..... 366/22
5,294,197 3/1994 Prill .
5,397,177 3/1995 Swisher, Jr. ..... 366/25

*Primary Examiner*—David Scherbel
*Assistant Examiner*—Randall E. Chin
*Attorney, Agent, or Firm*—Wheat, Camoriano, Smith & Beres, PLC

[57] ABSTRACT

A combination continuous/batch asphalt plant includes mechanisms and controls which permit it to be hot-stopped when operating in the continuous mode.

7 Claims, 6 Drawing Sheets

METHOD FOR OPERATING AN ASPHALT PLANT FOR BOTH CONTINUOUS AND BATCH OPERATION

BACKGROUND OF THE INVENTION

This is a divisional continuation of U.S. patent application Ser. No. 08/334,528 "ASPHALT PLANT FOR BOTH CONTINUOUS AND BATCH OPERATION", filed Nov. 4, 1994, now U.S. Pat. No. 5,556,197. The present invention relates to plants for the production of asphalt, and, in particular, to a plant that can be operated both in a batch mode and in a continuous mode.

In general, asphalt plants are made to operate only in a batch mode or only in a continuous mode. In a batch mode, the constituents of the asphalt product are carried by a bucket elevator into a batch tower, are individually weighed, are loaded into a mixer as a batch, are mixed together, and then are put into a silo for storage. In a continuous mode, the constituents of the asphalt product are continuously introduced into the mixer in the proper proportions and are moved through the mixer as it operates, so that the product continuously leaves the mixer. In general, a plant designed for continuous mode operation does not include a bucket elevator.

Some plants have been made to function both in a batch mode and in a continuous mode. This flexibility has been achieved by adding a rotary mixer to the traditional batch plant and feeding the mixer in a continuous mode or feeding the batch tower in a batch mode, as desired. This combined system is popular, due to the flexibility it adds to a traditional batch plant. However, there has been a shortcoming with known combined continuous/batch systems in that they cannot be "hot-stopped"—that is, they cannot be stopped for a temporary pause during operation.

There is a need to be able to "hot-stop" the combination plant when it is operating in continuous mode, for example, in the event that there is an emergency or in the event that a silo becomes full, while the operator knows that trucks are coming soon to unload the silo, and it would be desirable not to shut down the plant.

However, it has not been possible to "hot-stop" prior art combined continuous/batch plants, because they did not have controls that were sophisticated enough to control the mix of materials when production was suspended, and because they were not capable of stopping and starting under load. For example, in prior art combined plants, if the bucket elevator were stopped while the buckets were full of material, the elevator would reverse, dumping material at the bottom of the elevator. So, in prior art combined plants, a "hot stop" meant, among other things, that two people with shovels would have to spend an hour cleaning out the mess that was made when the buckets dumped their loads. Of course, once the buckets dumped their loads, it would take some time before the product coming out of the plant would be according to specifications, so the start-up after the prior art "hot stop" included the production of a substantial amount of waste. Also, in prior art combined plants, the rotary mixers are generally driven by trunnion drives, which, if stopped under load, have a great tendency to slip in trying to start back up again.

Another shortcoming of prior art combined system plants is that they waste a large amount of material during start-up and shut-down when operating in continuous mode. This happens, because it takes a period of time for the constituents of the asphalt to reach the right proportions as the plant is starting up, and everything that is produced before that time is wasted. Also, as the plant shuts down, the constituents of the asphalt stop entering the mixer in the right proportions, so everything produced thereafter is wasted.

Another shortcoming of prior art combined system plants is that they tend to create bad product when they are being shifted from one production level to another, for the same reasons cited above, again creating waste.

Another shortcoming of prior art plants is that they waste energy, because they use a damper to control the flow of fugitive emissions from the mixer to the burner, so the fugitive emissions fan constantly draws a high horsepower, even when the damper has been closed down to reduce the flow of air.

Another shortcoming of prior art plants is that there is turbulence as the fugitive emissions are introduced to the burner, which interferes with the burner flame.

SUMMARY OF THE INVENTION

The present invention solves many of the problems of the prior art.

The present invention provides the ability to "hot-stop" a combination continuous/batch plant without ill effects.

The present invention provides a control system for a combination continuous/batch plant which minimizes waste on start-up, shut-down, and in changes of production rates.

The present invention provides a special mechanism for the bucket elevators in the plant which prevents them from backing up when they stop and which provides a drive powerful enough to start under load. This is extremely important in order to permit hot-stopping of the plant.

The present invention provides a positive drive for the rotary mixer to avoid the problem of slippage which occurs when starting up under load. This is also important in order to permit hot-stopping of the plant.

The present invention provides a variable-speed fan for the fugitive emissions instead of using a damper to control the air flow, which provides substantial energy savings.

The present invention provides even distribution of fugitive emissions to the burner without creating turbulence.

DESCRIPTION OF THE PREFERRED EMBODIMENT

Figure 1:
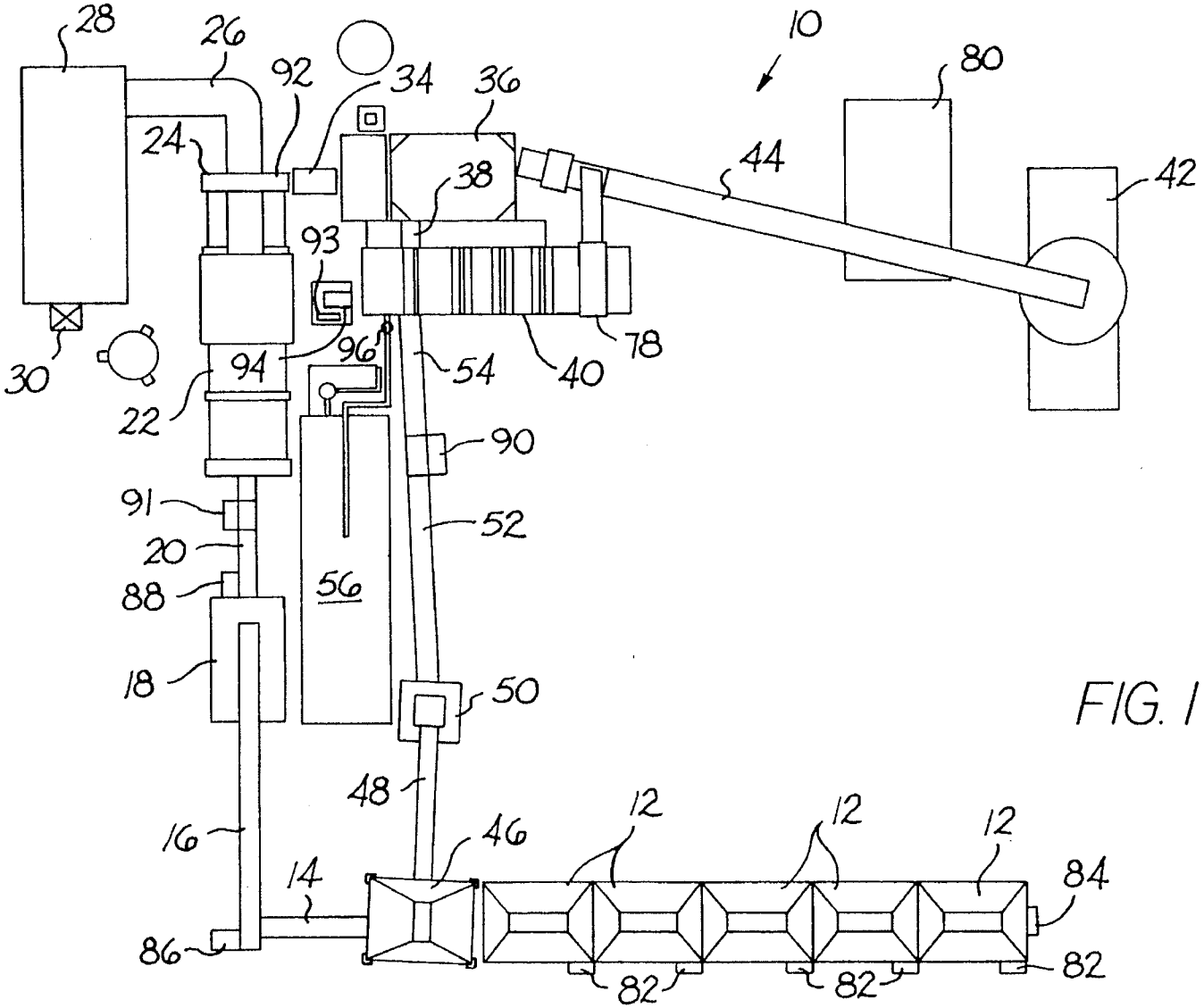
FIG. 1 is a schematic plan view of a combination continuous/batch asphalt plant made in accordance with the present invention.

FIG. 1 is a schematic top view of an asphalt plant 10 made in accordance with the present invention. As shown in this view, the plant 10 includes five cold feed bins 12, each of which generally holds a different size of aggregate. As is well-known in the art, feed belts (not shown) run below the cold feed bins 12, and these individual feed belts deposit material onto a collector belt 14, so that the collector belt 14 is carrying the proper mix of aggregate sizes for the particular asphalt to be made. The collector belt 14 then deposits the virgin aggregate material onto a transfer conveyor 16.

In this embodiment, the transfer conveyor 16 takes the virgin aggregate to a screen 18. The virgin aggregate leaves the screen 18 and is carried on a feed conveyor 20 to a counterflow dryer 22, which includes a burner 24. Ductwork 26 carries the moisture-laden air from the dryer 22 to a fabric filter or scrubber 28 before venting the air to atmosphere. The air is drawn through the ductwork 26 by a fan 30.

Figure 4:
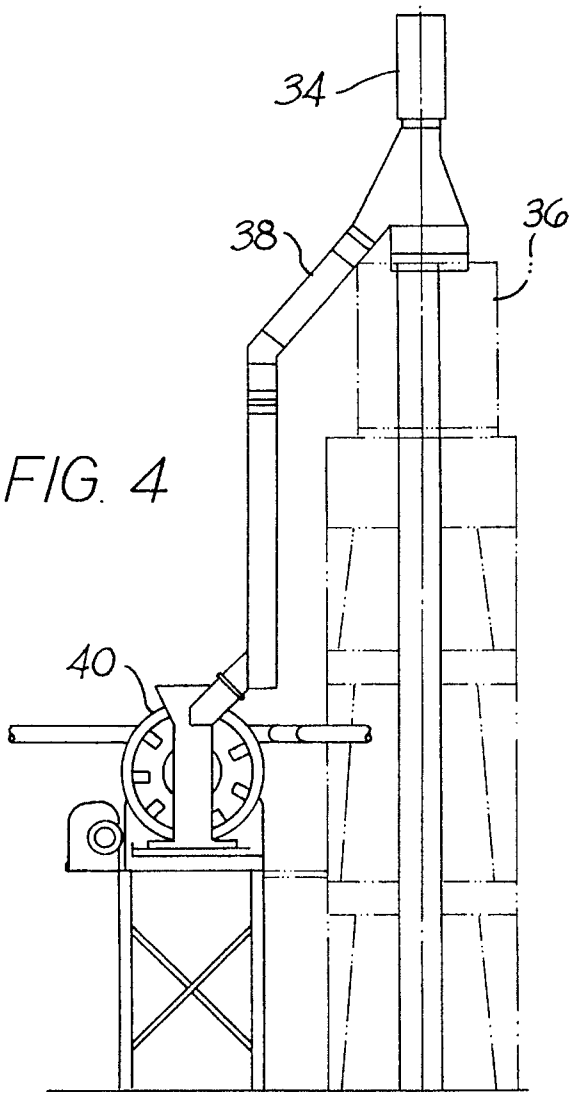
FIG. 4 is an end view of the same portion of the plant as FIG. 3.
Figure 3:
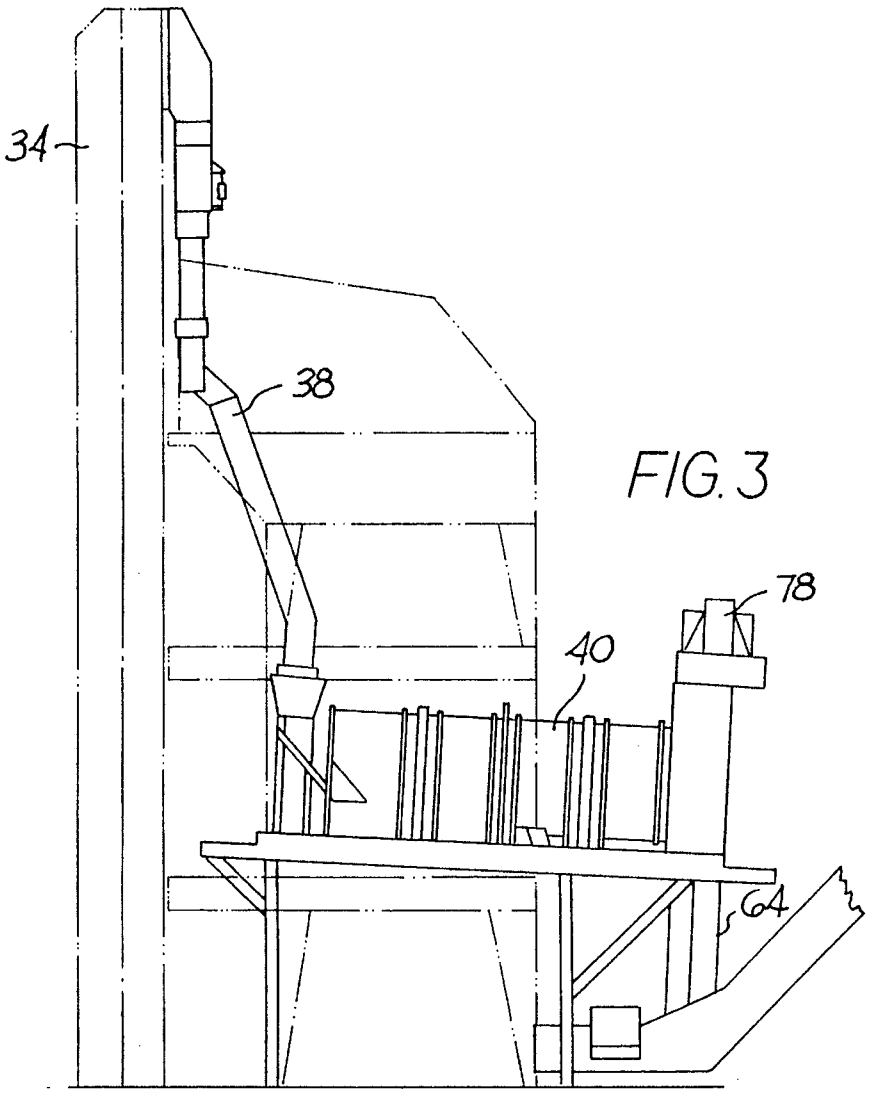
FIG. 3 is an elevation view of a portion of the asphalt plant of FIG. 1, showing the flow of material from the bucket elevator to the rotary mixer.

The dried virgin aggregate leaves the counterflow drum drier 22 onto a bucket elevator 34. The bucket elevator 34 has a special drive mechanism, which will be discussed in more detail later. The bucket elevator 34 lifts the dried virgin aggregate up to the top of a batch tower 36. At that point, a divert gate can be shifted so that the dried aggregate either goes into the tower or goes into a chute 38, which extends down to the continuous rotary mixer 40. The position of the divert gate is transmitted to the central controller 80 so it will know whether the plant is operating in continuous or batch mode. For continuous mode, the divert gate is positioned to send the hot aggregate to the chute 38 which leads to the continuous mixer 40. Better views of the chute 38 leading into the rotary mixer 40 are shown in FIGS. 3 and 4.

Referring again to FIG. 1, all the constituent parts of the asphalt meet at the rotary mixer 40, are mixed together there, and then leave the rotary mixer 40 to the silos 42 by means of the transfer conveyor 44.

The constituent parts of the asphalt are the dried virgin aggregate, which enters the rotary mixer 40 along the chute 38 as mentioned above, recycled asphalt, which arrives along the conveyor 52 as will be described later, and the liquid asphalt, which arrives by the pipe 54 from the tank 56.

The recycled asphalt gets to the mixer as follows: The chunks of recycled asphalt arrive at the asphalt plant 10 in trucks, which dump them into the bin 46. The recycled asphalt then is carried by the conveyor 48 to a crusher 50. After the recycled asphalt has been crushed, it is conveyed to the rotary mixer 40 by the conveyor 52. The recycled asphalt feed is shown in more detail in FIG. 2.

Figure 5:
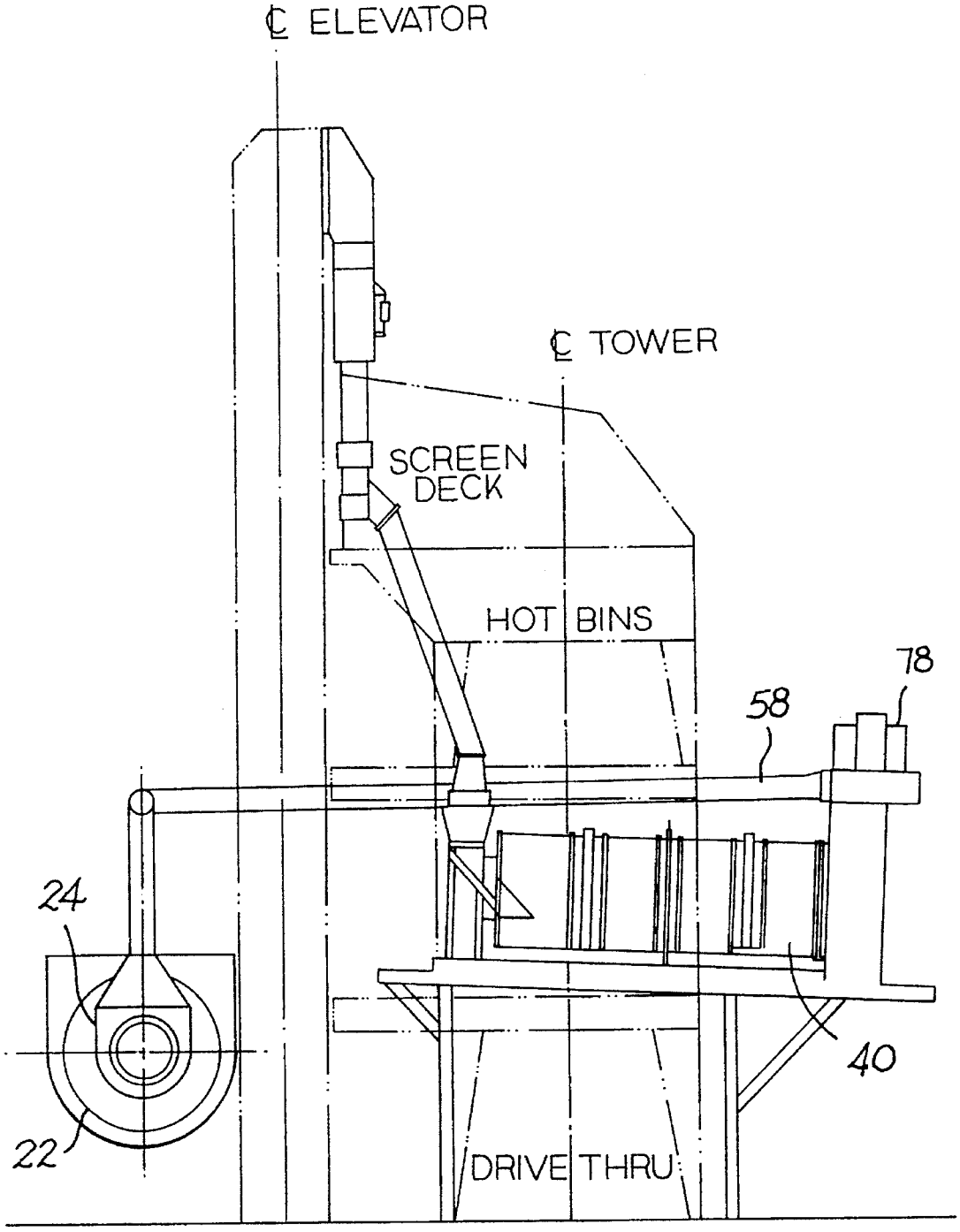
FIG. 5 is a view similar to the view of FIG. 3, but including the drying drum and the fugitive emissions path from the mixing drum to the burner for the drying drum.

As the hot dried virgin asphalt material is mixed with the recycled asphalt material and with the liquid asphalt in the rotary mixer 40, some of the material may vaporize, creating "blue smoke". In order to prevent any problems with emitting smoke into the atmosphere, a fugitive emissions system is provided to burn the "blue smoke" before it gets to the atmosphere. FIG. 5 shows that fugitive gas from the rotary mixer 40 is vented through the duct 58 to the burner 24 for the drier 22, where the vaporized material ("blue smoke") is burned. The fugitive gas from the rotary mixer 40 is drawn out of the mixer 40 and sent through the duct 58 by a fugitive emissions fan 78, mounted on top of the rotary mixer 40 as shown in FIG. 5.

Figure 7:
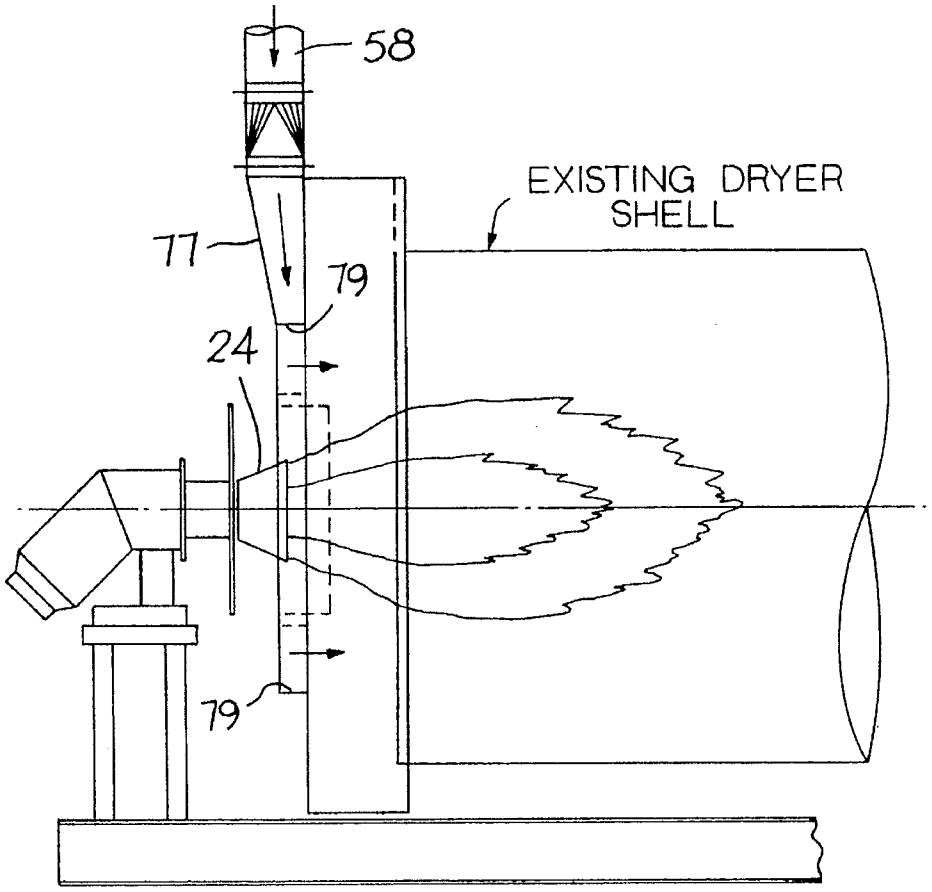
FIG. 7 is a side view of the burner end of the drying drum of FIG. 6.
Figure 6:
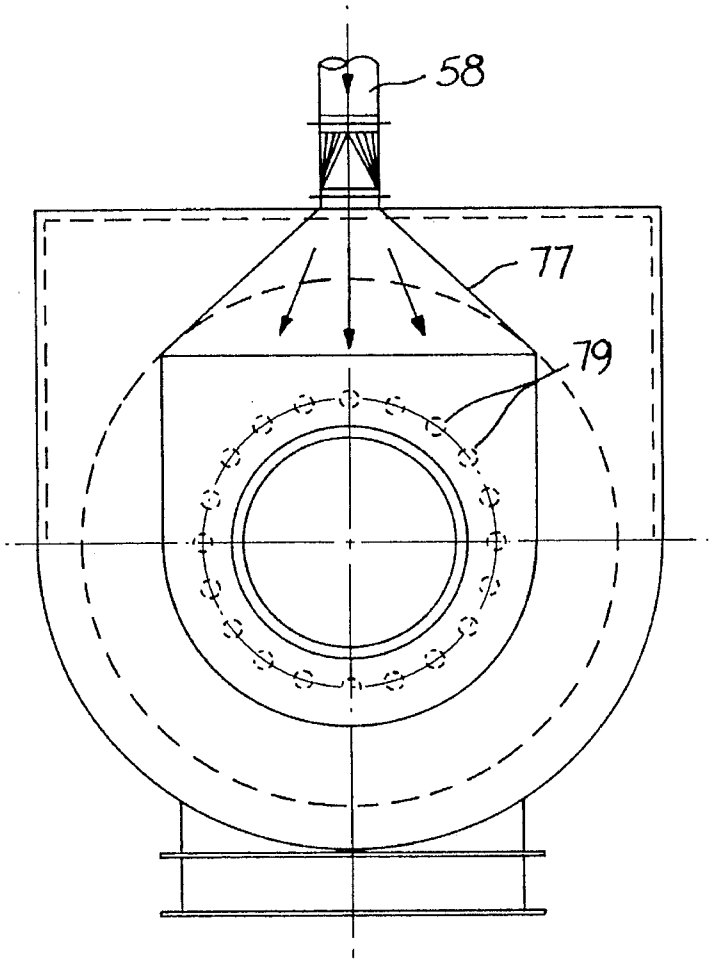
FIG. 6 is an enlarged sectional view of the drying drum of FIG. 3, showing the shroud and the fugitive emissions path into the burner.

FIGS. 6 and 7 show the fugitive emissions duct 58 which tapers as it approaches the burner 24. The fugitive emissions duct 58 includes a shroud 77 having a gradual taper and defining a plurality of holes 79 around the burner. This allows the air to slow down gradually as it approaches the burner and provides even distribution of air around the burner 24. The gradual slowing down of the air prevents turbulence and therefore feeds air to the flame without disturbing the flame.

Figure 2:
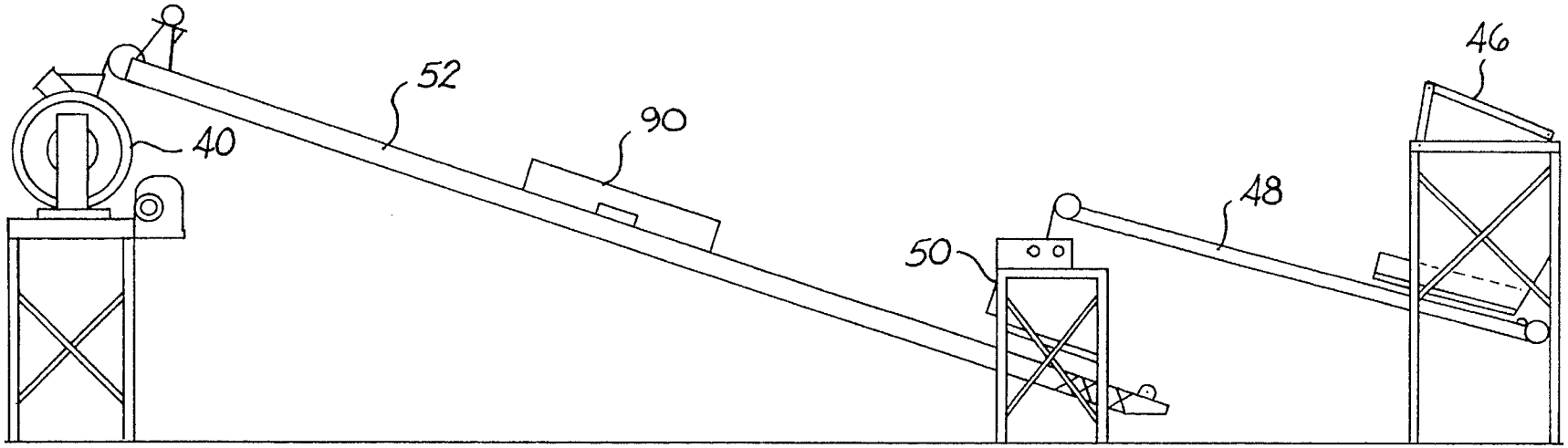
FIG. 2 is an elevation view of a portion of the asphalt plant of FIG. 1, showing the feed of the recycled asphalt to the rotary mixer.

FIG. 2 shows the recycled asphalt crusher 50, the conveyor 52 leading from that crusher to the mixer 40, and a belt scale 90, to weigh the crushed recycled asphalt as it moves toward the rotary mixer 40.

FIG. 3 also shows the rotary mixer 40, the bucket elevator 34, the chute 38 which takes the hot aggregate material from the bucket elevator 34 to the mixer 40, and a discharge chute 64 from the mixer 40.

Figure 8:
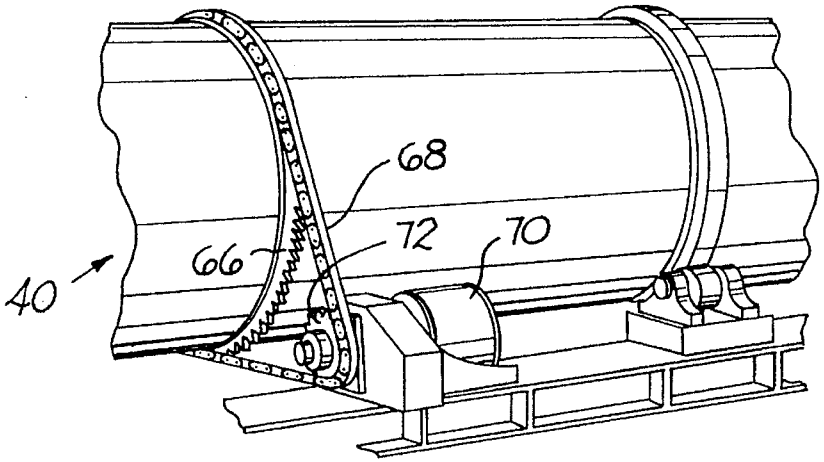
FIG. 8 is a perspective view of the drive portion of the rotary mixer of the asphalt plant of FIG. 1.

FIG. 8 shows the drive mechanism for the continuous rotary mixer 40, which includes a large sprocket 66 surrounding the mixer 40 and attached to the mixer 40. A chain 68 wraps around the large sprocket 66 and is driven by a motor 70 and small sprocket 72. This drive mechanism provides a positive drive, which is very important when the asphalt plant is started up under load, such as when the mixer 40 is full of material.

Figure 9:
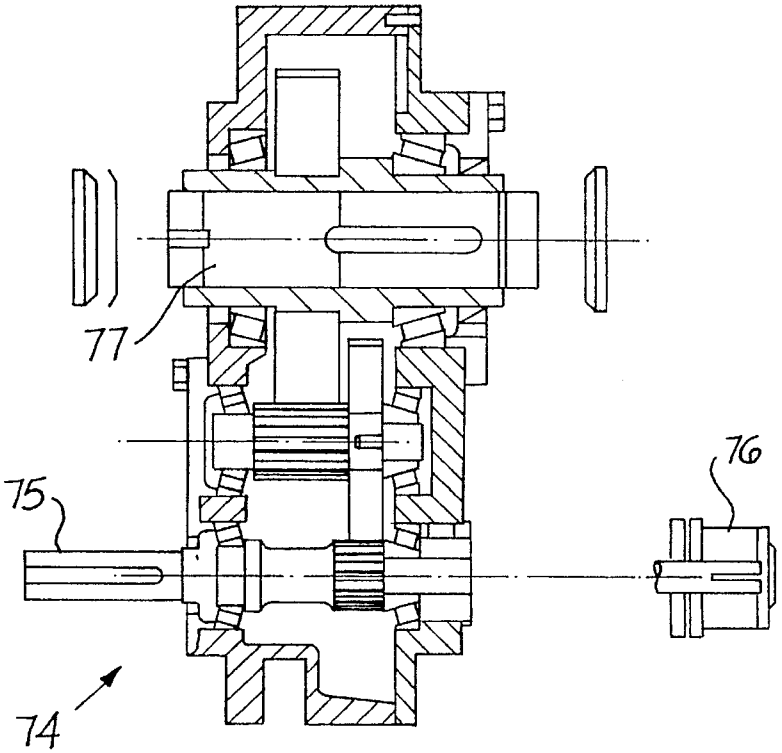
FIG. 9 is an exploded view, partially in section, of the gear reducer and backstop portion of the bucket elevator drive in the bucket elevator of the plant shown in FIG. 1.

FIG. 9 shows the drive mechanism 74 which is located at the top of the bucket elevator 34. This drive mechanism 74 is of the type sold by Foote-Jones/Illinois Gear. This drive 74 is substantially more powerful than standard bucket elevator drives, so that it can start up when the buckets are full of material. It includes a high speed shaft 75, which is driven by the drive motor (not shown), and a low speed shaft 77, which is gear-driven from the high speed shaft 75. It also includes a sprag-type backstop mechanism 76, which is mounted on the high speed shaft 75 and which prevents the bucket elevator from reversing if it is stopped under load.

This asphalt plant has a very sophisticated control system. Looking again at FIG. 1, there is a central controller 80, which is wired to sensors and actuators throughout the plant. Each feeder belt drive has a drive shaft at one end and a tail shaft at the other end. Each tail shaft has an encoder, which signals the speed of the belt and transmits that information to the central controller 80. So, in this embodiment, there are five encoders 82 at the tail shafts of the five feed belts for the five cold feed bins 12. There is an encoder 84 at the tail shaft for the collector belt 14. There is an encoder 86 at the tail shaft of the transfer conveyor 16, and there is an encoder 88 at the feed conveyor 20. There is also a belt scale 91 on the aggregate feed conveyor 20, and a belt scale 90 on the conveyor 52 for the recycled aggregate.

All the motors driving the belts are variable speed motors, controlled by the central controller 80. There is a temperature sensor 92 measuring the temperature of the hot aggregate leaving the drying drum 22, and there is an actuator (not shown) controlling the amount of fuel and air to the burner 24 on the drying drum 22.

There is a "no-flow" paddle (not shown) on each feed bin 12, which indicates to the central controller 80 when there is no product flowing onto the feed belt from the feed bin. This can occur if there is a jam or bridge in the bin or if the bin is empty. If the central controller 80 receives a signal from the "no-flow" paddle indicating that no material is flowing onto the feed belt, it will sound an alarm and will temporarily stop the plant. (A hot-stop or temporary stop is described below.)

There is a skid containing a liquid asphalt pump 93 and flow meter 94, indicating the flow rate of the liquid asphalt into the mixer 40, and the controller 80 controls the speed of the liquid asphalt pump 93 to maintain the proper flow rate. There is also a temperature sensor in the liquid asphalt line 54, which tells the central controller the temperature of the liquid asphalt so the central controller can take the liquid asphalt temperature into account in setting the flow rate.

Control of the asphalt plant is as follows:

In order to start up the plant, the operator starts the exhaust fan 30 which draws air through the drying drum 22. The operator also starts up the liquid asphalt pump 93 so that liquid asphalt fills the line 54 and recirculates back to the tank 56. The operator also starts up the air compressor (not shown) to provide compressed air to actuate valves in the plant. The combustion blower is started up to provide air to the burner 24. The fugitive emissions fan 78 on the rotary mixer 40 is started up. The drag slat conveyor 44 is started up. The fire is started in the burner 24 for the drying drum 22. Then the operator tells the central controller 80 what the production rate is to be and tells the central controller to start feeding material.

This automatically causes a horn (not shown) to sound. Then everything upstream of the mixing drum 40 automatically starts up. The controller 80 sequentially starts up the feeder belts on the cold feed bins 12 and, by the encoders 84 on the tail shafts, monitors the speed of those belts. The controller 80 then controls the speed of the drive motors while sensing the belt speed to maintain the proper belt speeds.

When the weigh bridge 91 on the feed conveyor 20 begins to indicate that aggregate material is present, the controller knows from the belt speed and the weight what the flow rate of aggregate is to the drying drum 22. The controller knows how long it will take material to get from the scale 91 to the injection point of liquid asphalt in the mixer 40, and it starts a timer which will tell the asphalt valve 96 when to open. The asphalt line 54 stays full so that, as soon as the valve 96 is opened, asphalt will begin to enter the mixer 40. The controller also measures and times the feed of the recycled asphalt product so the correct amount of recycled asphalt reaches the mixer 40 at the correct time.

The central controller 80 is constantly checking the virgin asphalt material scale 91 and belt speed, the recycled asphalt scale 90 and belt speed, and the asphalt flow meter 94 and is constantly adjusting feeder belt speeds and the asphalt pump speed to maintain the correct flow rates of the multiple feed materials.

The central controller 80 includes logic to incrementally control changes in production rates, so that the flow rates of all materials are controlled together, greatly reducing waste.

There is a sensor (not shown) on the mixer 40, which senses the negative air pressure created by the fugitive emissions fan 78, and the central controller 80 controls the speed of the fan motor for the emissions fan 78 to maintain constant negative pressure.

In the event of a hot stop, such as if there is an emergency or if the silo 42 is full but it is not desirable to completely shut down the plant, everything is instantaneously stopped by the central controller 80. All the feed conveyors and the asphalt feed are stopped. The dryer 22 stops rotating. The bucket elevator 34 stops while full of material, and the mixer 40 stops. It is in this hot-stop that it is essential to have a backstop on the bucket elevator 34 to prevent the bucket elevator from backing up and dumping everything into the boot section of the elevator 34, and it is essential to have enough power and positive drive for the bucket elevator 34 and the mixing and drying drums 40, 22 so they can all start up under load.

Then, when the emergency is resolved or a truck unloads material from the silo 42, the central controller 80 starts everything up instantaneously.

To shut down the plant for the day, the central controller 80 automatically shuts down the feeds sequentially, timing the shut-down so that the proper mix of materials continues to reach the mixer 40 until all materials stop reaching the mixer 40 at once. Again, this minimizes the amount of waste.

What is claimed is:

1. A method for operating a combined continuous/batch asphalt production plant to produce asphalt with components in certain ratios according to a specification, including a cold feed bin for virgin aggregate material, a bucket elevator, a batch tower, a liquid asphalt feed, a continuous drier drum including a burner, and a continuous mixer, comprising the steps of:

automatically and continuously controlling and measuring the flow of aggregate material from the cold feed bin, to the drier, then along the bucket elevator, and then to the mixer;

automatically and continuously controlling and measuring the flow of material from the liquid asphalt feed to the mixer; and automatically and continuously measuring and controlling the temperature of the material leaving the drier;

wherein, during start-up, shut-down, and changes of production levels and immediately after a hot-stop, the proper ratios of materials are maintained in the mixer, and the proper temperatures are controlled in the drier.

2. A method for operating a combined continuous/batch asphalt production plant as recited in claim 1, wherein said plant includes a recycle asphalt feed, and further comprising the step of:

automatically and continuously controlling and measuring the flow of material from the recycled asphalt feed to the mixer.

3. A method for operating a combined continuous/batch asphalt production plant as recited in claim 1, and further comprising the steps of:

temporarily stopping the plant, wherein the bucket elevator includes a back-stop to prevent it from dumping its load when it stops; and starting up the plant after the temporary stop, wherein the bucket elevator starts under load after a temporary stop.

4. A method for operating a combined continuous/batch asphalt production plant as recited in claim 3, wherein the drier drum is driven by a positive drive, to enable it to start under load after a temporary stop.

5. A method for operating a combined continuous/batch asphalt production plant, to produce asphalt with components in certain ratios according to a specification, including a cold feed bin for virgin aggregate material, a bucket elevator, a batch tower, a liquid asphalt feed, a continuous drier drum including a burner, and a continuous mixer, comprising the steps of:

automatically and continuously controlling and measuring the flow of aggregate material from the cold feed bin, to the drier, then along the bucket elevator, and then to the mixer;

automatically and continuously controlling and measuring the flow of material from the liquid asphalt feed to the mixer;

automatically and continuously measuring and controlling the temperature of the material leaving the drier;

temporarily stopping the plant with aggregate on the bucket elevator and in the drier and with aggregate and liquid asphalt in the mixer;

then starting the plant again, while maintaining the proper ratios of materials in the mixer before, during, and after the temporary stop.

6. A method for operating a combined continuous/batch asphalt production plant as recited in claim 5, wherein, during the temporary stop, the bucket elevator continues to hold the aggregate that was on the bucket elevator at the time it was stopped, and wherein, after the temporary stop, the bucket elevator starts up in a loaded condition.

7. A method for operating a combined continuous/batch asphalt production plant as recited in claim 6, wherein, during the temporary stop, the drier drum continues to hold the aggregate that was in the drier drum at the time it was stopped, and wherein, after the temporary stop, the drier drum starts up in a loaded condition.

* * * * *